US007959373B1

(12) United States Patent
Brown

(10) Patent No.: US 7,959,373 B1
(45) Date of Patent: Jun. 14, 2011

(54) SLIDING GATE APPARATUS

(76) Inventor: James C. Brown, Fort Wayne, IN (US)

( * ) Notice: Subject to any disclaimer, the term of this patent is extended or adjusted under 35 U.S.C. 154(b) by 83 days.

(21) Appl. No.: 12/587,633

(22) Filed: Oct. 9, 2009

(51) Int. Cl.
*E01F 13/00* (2006.01)

(52) U.S. Cl. ..... 404/6; 404/9; 256/13.1

(58) Field of Classification Search ..... 404/6, 9–10; 256/13.1
See application file for complete search history.

(56) References Cited

U.S. PATENT DOCUMENTS 5,181,794 A * 1/1993 Wilson et al. ..... 404/6
7,354,218 B1 * 4/2008 Dyke et al. ..... 404/6
7,410,321 B1 * 8/2008 Schiefferly et al. ..... 404/6
7,481,598 B2 * 1/2009 Jankovsky ..... 404/6
2007/0126598 A1 * 6/2007 Carter et al. ..... 340/908

FOREIGN PATENT DOCUMENTS

GB 2092986 A * 12/1981

* cited by examiner

*Primary Examiner* — Raymond W Addie
(74) *Attorney, Agent, or Firm* — Susan L. Firestone; Paul W. O'Malley

(57) ABSTRACT

A gate apparatus has a pair of spaced apart base assemblies and a gate assembly. Each base assembly has a base frame with leg assemblies and braces and a receiver attaching to the top of the base frame and having a guide mechanism. The gate assembly has a beam engaging the guide mechanism of at least one of the receivers and wheel assemblies attached to each end the beam.

22 Claims, 8 Drawing Sheets

SLIDING GATE APPARATUS

BACKGROUND

Embodiments disclosed herein relate to a sliding gate apparatus.

Public buildings and other locations are often protected by barriers, such as fences with or without gates. When gates are used as checkpoints, they close off a passageway to restrict entrances and exits from the location, especially by vehicles. When in a closed position, gates lie perpendicularly across the roadway to obstruct traffic. When in the open position, gates often have a hinged arm which raises or a sliding beam which slides on a track to allow traffic through.

SUMMARY

A gate apparatus has spaced apart base assemblies and a sliding gate assembly. Each base assembly has a base frame and a receiver. Each base frame has a base top, first and second leg assemblies extending from opposite sides of the base top and braces attaching the first leg assembly to the second leg assembly. Each receiver has a receiver frame attaching to the base top of the of the base frame. The receiver frame has opposite first and second sides and a third side connecting the first and second sides opposite the base frame.

A guide mechanism attaches to each receiver and engages the sliding gate assembly. The sliding gate assembly has a beam with opposite ends, the beam engaging the guide mechanism of at least one of the receivers, and wheel assemblies attaching to each end the beam.

DETAILED DESCRIPTION

Figure 1:
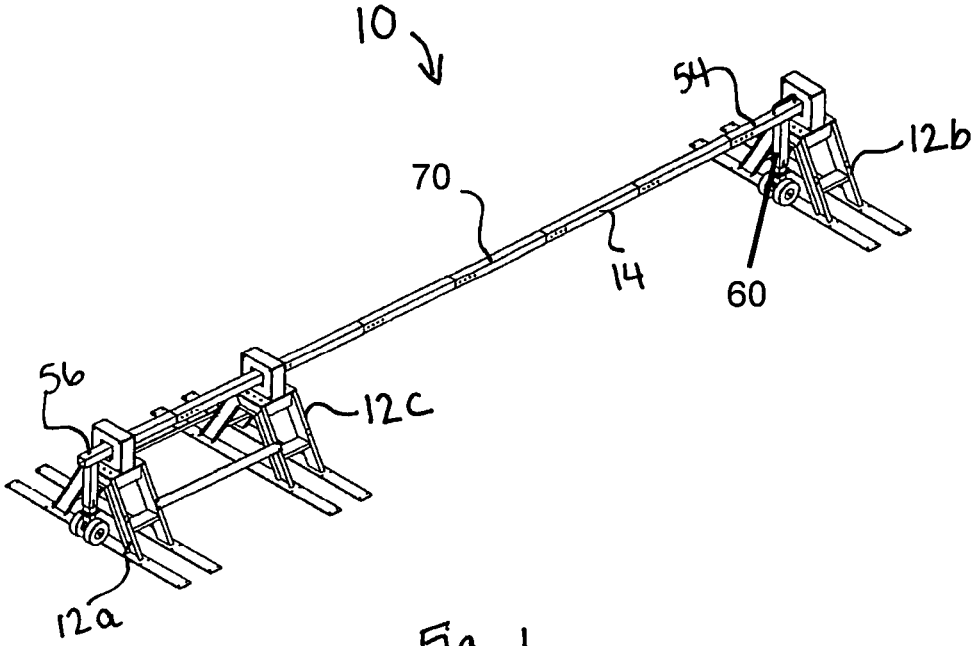
FIG. 1 is a perspective view of a sliding gate apparatus in a closed position.

Turning to the Figures, where like reference numerals refer to like elements, a gate apparatus 10, 11 has spaced apart base assemblies 12 and a gate assembly 14, 15 engaging at least one of the base assemblies 12. Each base assembly 12 has a base frame 16 and a receiver 18.

The base frame 16 has a base top 20 and first and second leg assemblies 22, 23 extending from opposite sides of the base top 20. First braces 24, 25 are connected to the first and second leg assemblies 22, 23. Second braces 26, 27 are connected to the first and second leg assemblies 22, 23 below the base top 20.

Each leg assembly 22, 23 has a first and second leg 92, 93 and a top portion 90 therebetween. The leg assemblies 22, 23 can have lips 116, 117 at the edges. The first and second legs 92, 93 can connect to the top portion 90 at an angle $\alpha$ ranging from about 90 deg to about 118 deg., such as 117.25 deg. The bottom of the first and second legs 92, 93 can be angled to the ground or foundation 94 at an angle $\beta$ ranging from about 62 deg to about 90 deg., such as 62.75 deg.

A foundation 94 can be used with base assembly 12. Foundation 94 attaches to the base frame 16 at the bottom of the first and second leg assemblies 22, 23. The foundation 94 can be a rectangular slat extending outwardly from each leg assembly, or any other design engaging the base assembly 12, such as a floor.

The receiver 18 has a receiver frame 36 to which one or two covers 48, 49 can attach. The covers 48, 49 have a cover opening 50. The receiver frame 36 attaches to the base top 20 of the base frame 16. The receiver frame 36 has a first side 30, an opposite second side 32 and a third side 34 located between the first and second sides 30, 32 opposite the base top 20. The receiver frame 36 can have a plate 28 attaching to the base top 20, the first side 30 and the second side 32. The width of the sides 30, 32, 34 can be less than the width of the plate 28. Corner plates 38 can be used at the corners 40 formed by the sides 30, 32, 34 and the plate 28 of the receiver frame 36.

A guide mechanism 42 attaching to the receiver 18 engages the gate assembly 14. Guide mechanism 42 can attach to the receiver frame 36 or cover 49. At least part of the guide mechanism 42 is accessible through the cover opening 50. The guide mechanism 42 can include a first roller 44 or wheel engaging a first roller frame 46, bearings, bushings and the like. Each roller frame 46 can attach to one of the sides 30, 32, 34 or the plate 28 at one end with the axis of the roller 44 at the other end.

The gate assembly 14 has at least one wheel assembly 60 attached to each end of a beam 52, 53. The upper portion of the wheel assembly 60 engages the beam 52, 53. Wheel assembly 60 can have an upper wheel tube 64 engaging a lower wheel tube 66, such as by aligning holes on the upper wheel tube with holes on the lower wheel tube and fastening. One or more wheels 62 are located at each end of an axle 68 that engages the lower wheel tube 66.

A nose end 54 of beam 52, 53 inserts through the receiver 18 and engages the guide mechanism 42 of one of the base assemblies. A nose 55 can be tapered and can extend out of the receiver 18 when the gate assembly 10 is closed. A locking mechanism 110 inserts into an opening 99 to lock the beam 52 in position. A handle 73 opposite the wheel assembly 60 can be used to move the beam 52 of the gate assembly 14 into and out of the receiver 18 when opening or closing the gate apparatus 10.

Figure 18:
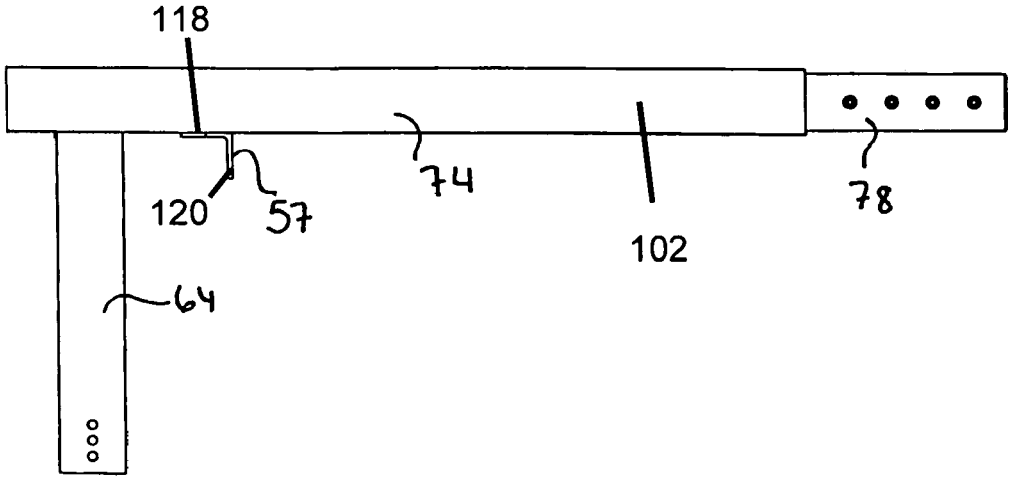
FIG. 18 is a side view of a tail unit.
Figure 19:
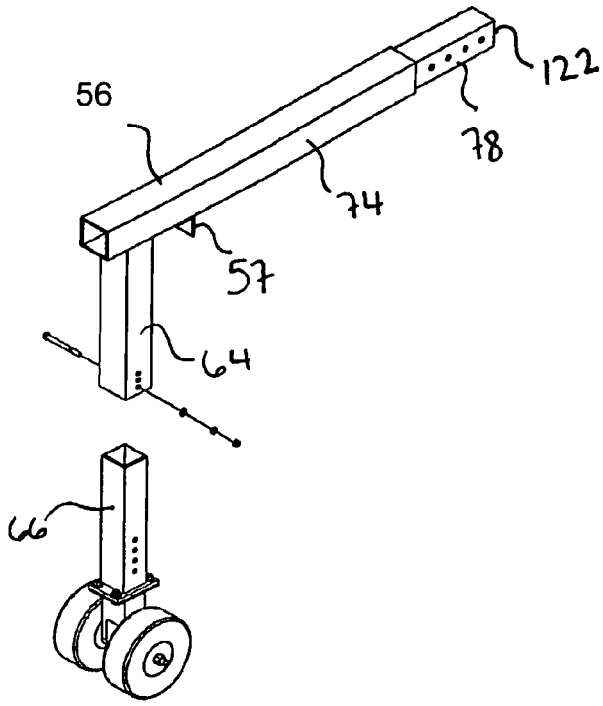
FIG. 19 is an exploded view of an end unit.
Figure 20:
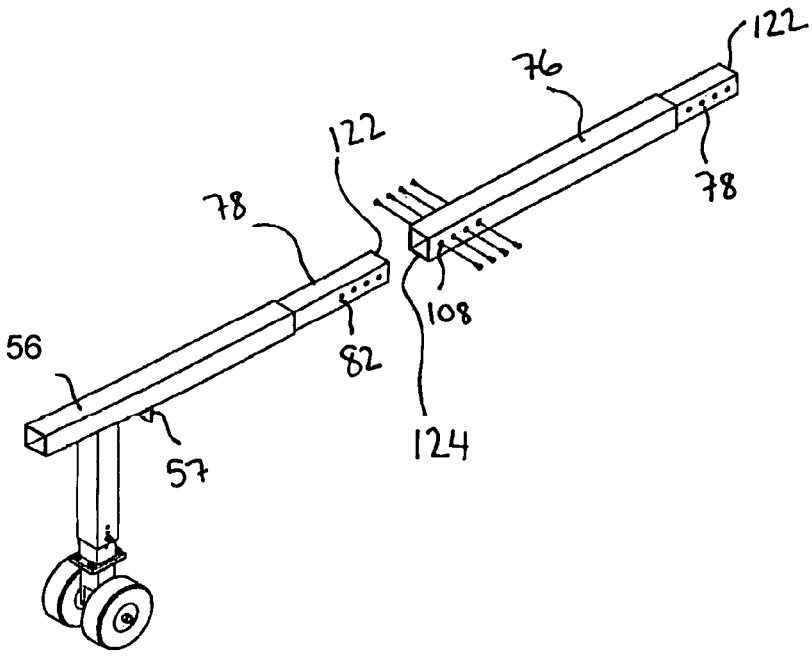
FIG. 20 is an exploded view of an end unit and a spacer unit.

When closed, a tail end 56 opposite the nose end 54 inserts through the receiver 18 and engages the guide mechanism 42 of the first base assembly 12*a*. The tail end 56 has a stop 57 projecting from the tail end 56 between the wheel assembly 60 and the first base assembly 12*a*. The stop 57 can be a handle extending from the tail end or the stop 57 can have a first flange 118 attaching to the beam 52 at the tail end 56 and a flange 120 projecting away from the first flange 118. While FIG. 18 shows stop 57 attaching to the bottom of tail end 56, stop 57 can attach on any side of the tail end 56.

When the gate assembly 10, 11 is closed, the tail end 56 of the beam 52 has the wheel assembly 60 located laterally to first base assembly 12*a* and the beam 52 is inserted through the receiver 18. The nose end 54 of the beam 52 inserts through the receiver 18 of second base assembly 12*b*, with the wheel assembly 60 located between the first and second base assemblies 12*a*, 12*b*. The beam 52 engages the guide mechanism 42 of the receivers 18 of both base assemblies 12*a*, 12*b*.

When the gate assembly 10, 11 is open, the beam 52 slides through the receivers 18 of the base assemblies 12*a*, 12*b*. The nose end 54 slides on the guide mechanism 42 and out of the second base assembly's 12*b* receiver 18 to disengage from the second base assembly 12*b*. The tail end 56 slides laterally away from the first base assembly 12*a*, and the beam 52 within the cover opening 50 slides on the guide mechanism 42 of the receiver 18. The nose end 54 slides toward the base assembly 12*a*.

Additional base assemblies, such as third base assembly 12*c*, can be located between the first and second base assemblies 12*a*, 12*b*. A connector 96 links the first base assembly 12*a* to the third base assembly 12*c*, such as a leg assembly of the first base assembly 12*a* to a leg assembly of the third base assembly 12*c*.

The beam can be a single unit (beam 53) or can be modular (beam 52) and form from a number of tube units 70 that matingly engage each other, such as with a male end 122 of one tube unit inserted into a female end 124 of another tube unit 70. The male end 122 of a tube unit 70 can include an alignment tube 78. Alignment tube 78 has a first alignment aperture 80 on a first side 84, and an second alignment aperture 82 on the opposite second side 85. An alignment insert 86 within the alignment tube 78 extends from the first alignment aperture 80 to the second alignment aperture 82.

The nose end 54 can have a nose unit 72. Nose unit 72 has a nose tube 98 with alignment holes 100 in the sides of the nose tube 98 at the female end 124 opposite the tapered nose 55. Alternatively, the nose unit can have a male end with an alignment tube extending outwardly opposite the nose.

The tail end 56 can have a tail unit 74. The tail unit 74 can have an alignment tube 78 at the male end 122 opposite the wheel assembly 60 end. The stop 57 is located between the wheel assembly 60 and the alignment tube 78. Alignment tube 78 partially inserts within a tail tube 102 of the tail unit 74 and fastens therewith. The alignment apertures 80, 82 of the alignment tube 78 are located outside of the tail tube 102. Alternatively, the tail unit can have a female end opposite the wheel assembly end.

Spacer units 76 can be used between the nose unit 72 and the tail unit 74 to lengthen the beam 52. A spacer unit 76 has a female end 124 and a male end 122. A spacer tube 106 has an alignment hole 108 on a first end, and an alignment tube 78 located at the opposite end. Alignment tube 78 partially inserts within the spacer tube 106 with the alignment apertures 80, 82 located outside of the spacer tube 106.

The beam 52 is assembled from the tube units 70. The nose unit 72 matingly engages the alignment tube 78 of a spacer unit 76 or the tail unit 74. After aligning the alignment hole 100 and the alignment apertures 80, 82, the nose unit 72 and spacer unit 76 are fastened together with fasteners inserted through the alignment holes 100 and the alignment apertures 80, 82 and into the insert 86. The alignment tube 78 of the tail unit 74 is inserted into the female end 124 of the spacer tube 106 of the spacer unit 76. The tail unit 74 and spacer unit 76 are fastened together with fasteners after aligning the alignment hole 108 of the spacer unit 76 and the alignment apertures of the tail unit 74 and into the insert 86. Spacer units 76 can fasten to each other with the male ends 122 matingly engaging the female ends 124.

Figure 2:
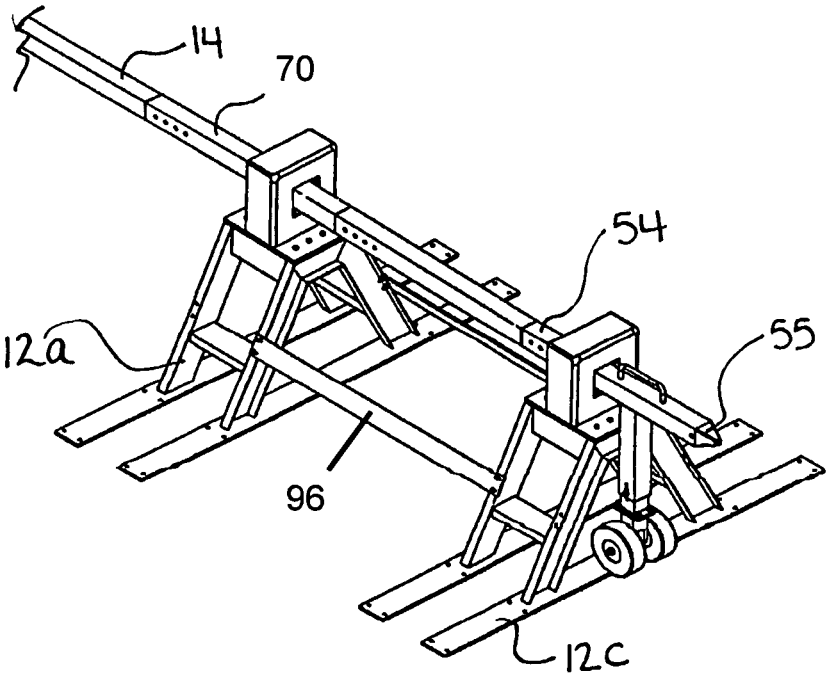
FIG. 2 is a partial perspective view of two base assemblies engaging a gate assembly in an open position.
Figure 3:
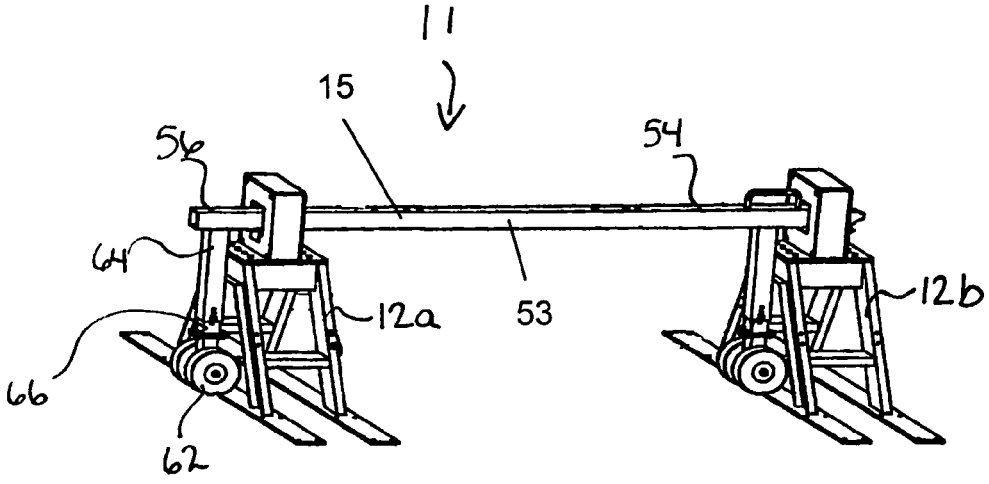
FIG. 3 is a perspective view of a sliding gate apparatus in a closed position.
Figure 4:
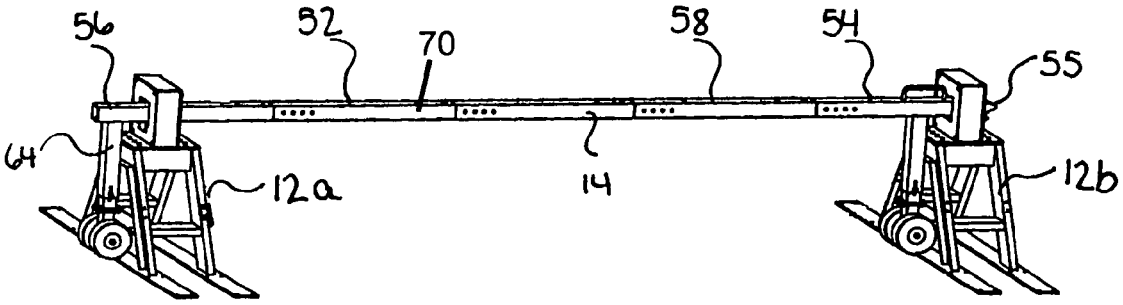
FIG. 4 is a perspective view of a sliding gate apparatus in a closed position.
Figure 5:
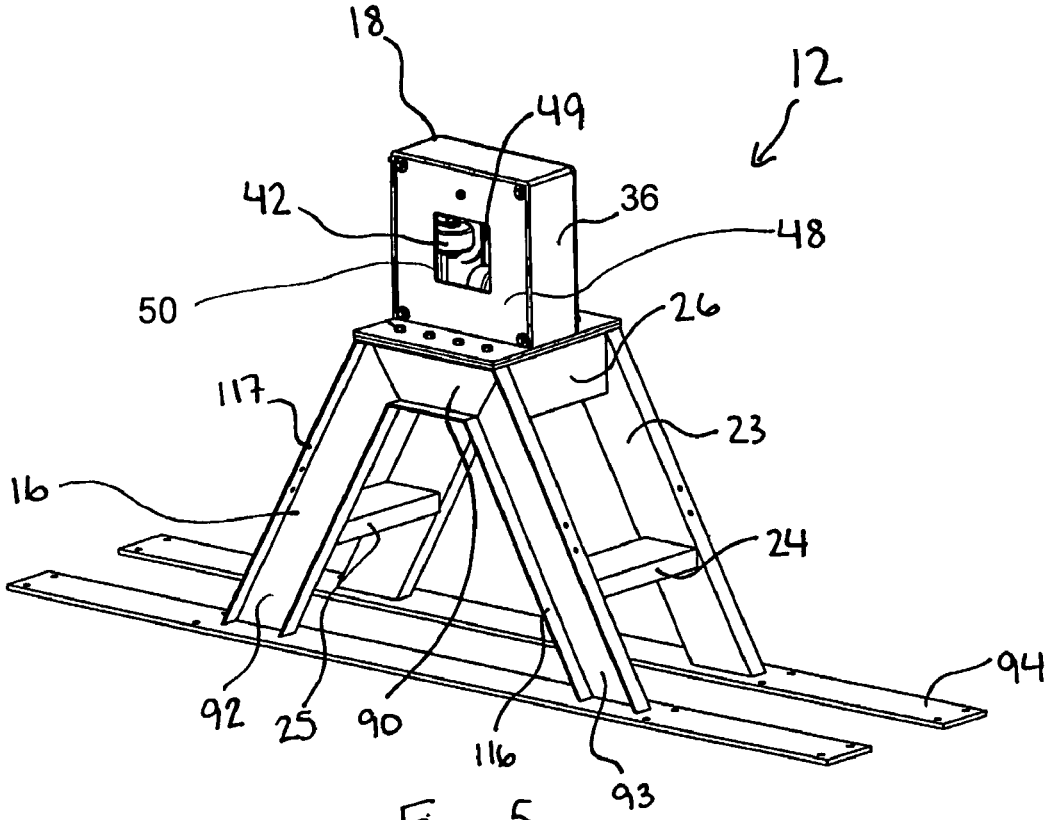
FIG. 5 is a perspective view of a base assembly.
Figure 6:
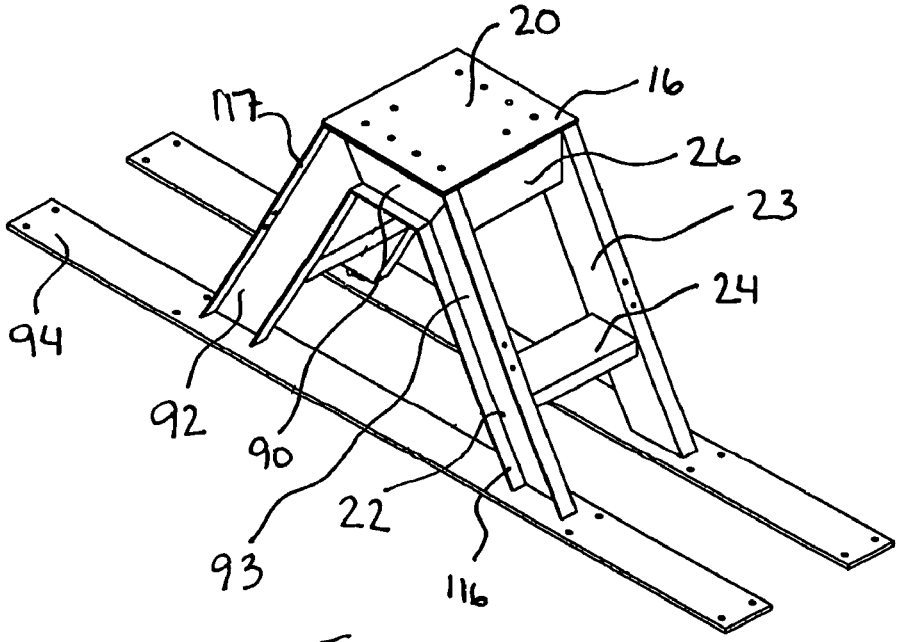
FIG. 6 is a perspective view of a base frame.
Figure 7:
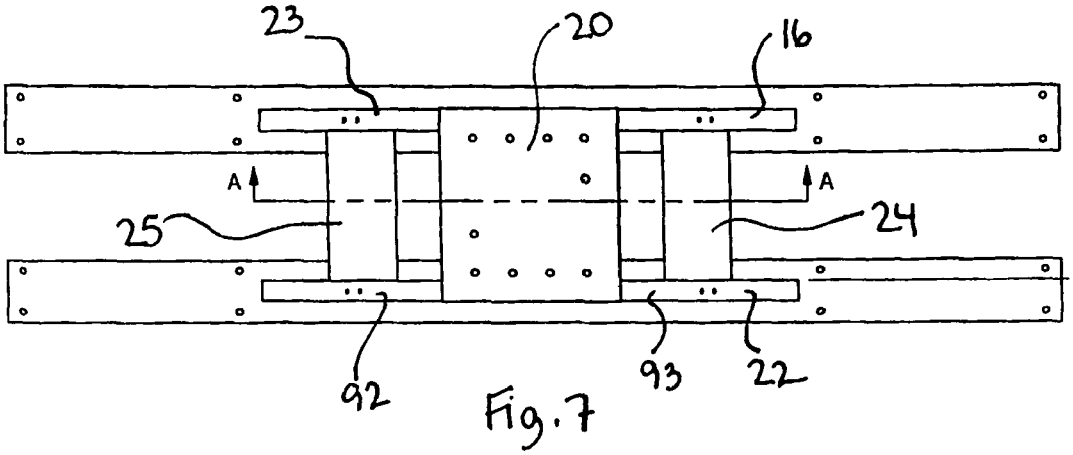
FIG. 7 is a top plan view of a base frame.
Figure 8:
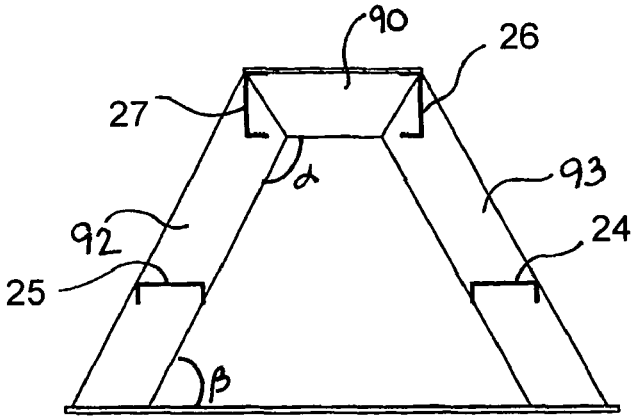
FIG. 8 is a view along line A-A of the base frame of FIG. 7
Figure 9:
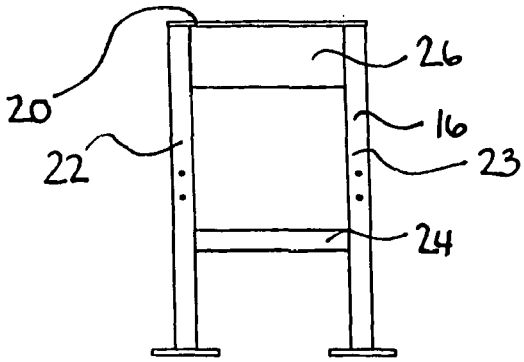
FIG. 9 is a front view of a base frame.
Figure 10:
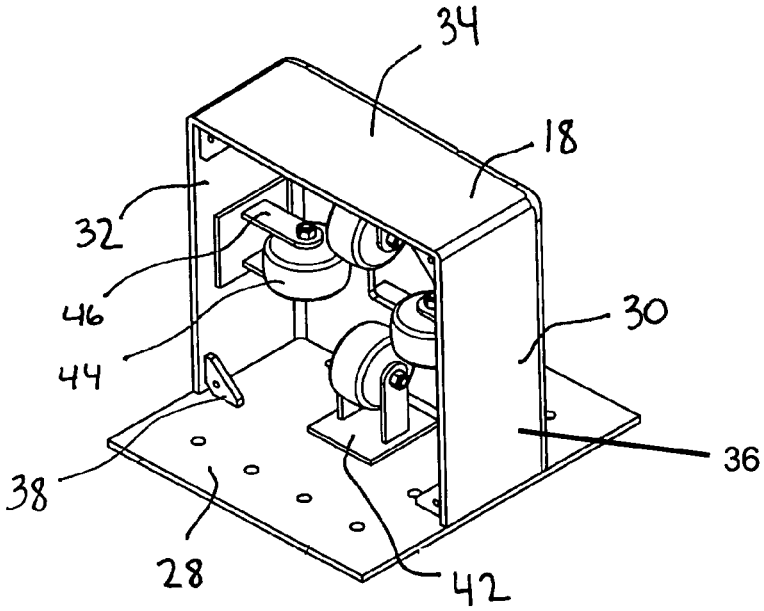
FIG. 10 is a perspective view of a receiver with one cover.
Figure 11:
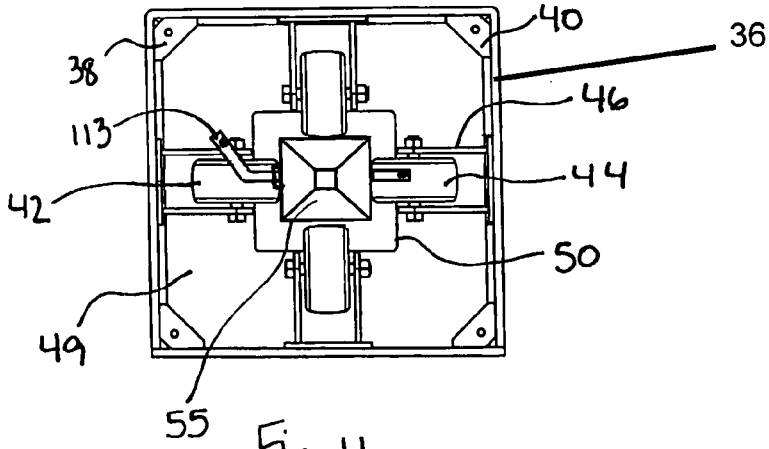
FIG. 11 is a plan view of a receiver engaging the nose end of the gate assembly with a cover removed.
Figure 12:
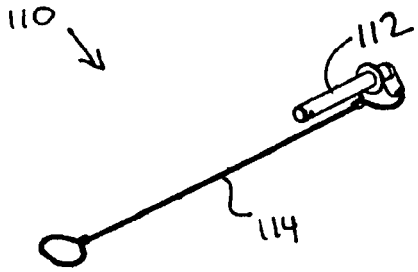
FIG. 12 is a perspective view of a locking mechanism.
Figure 13:
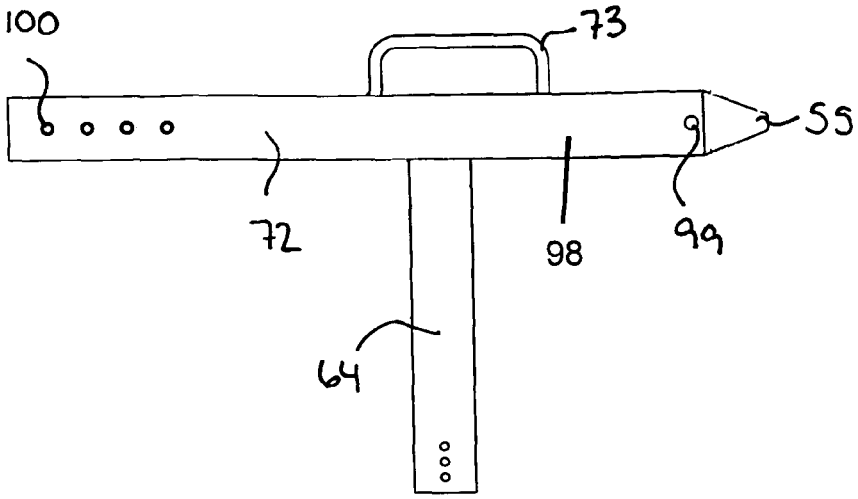
FIG. 13 is a side view of a nose unit.
Figure 14:
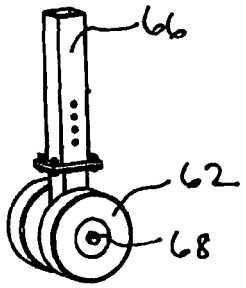
FIG. 14 is a perspective view of a lower wheel assembly.
Figure 15:
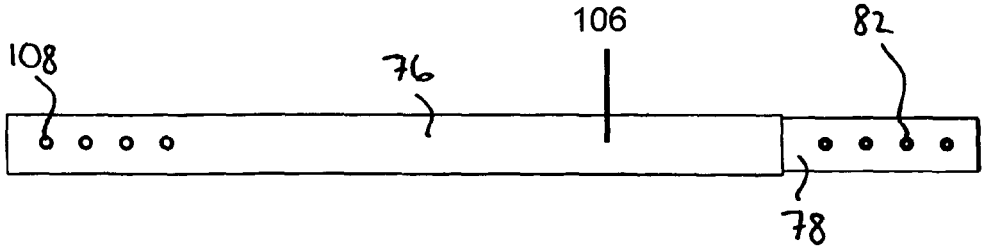
FIG. 15 is a side view of a spacer unit.
Figure 16:
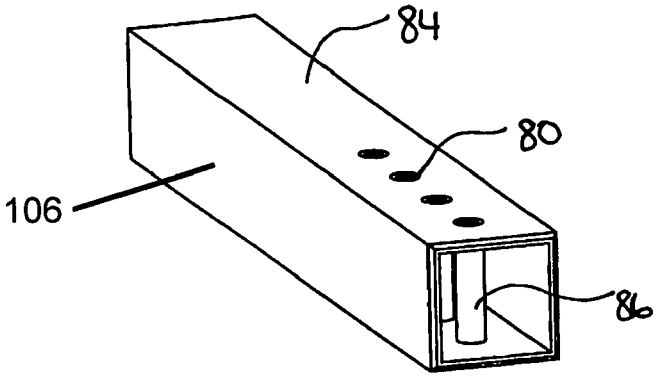
FIG. 16 is a perspective view of an alignment tube.
Figure 17:
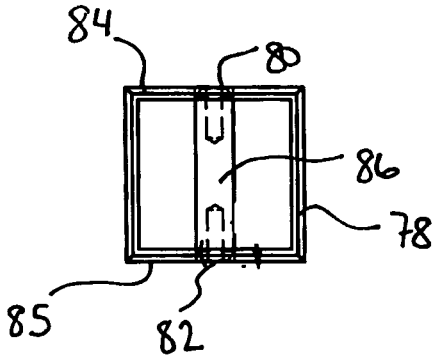
FIG. 17 is a plan view of one end of an alignment tube with fasteners in phantom.

The gate apparatus 10,11 can be assembled with the base assemblies 12 anchored to the ground or a foundation such as concrete using fasteners or held in place using ballast on the ends of a building or fence foundation. When using more than two base assemblies, nearby base assemblies fasten together with connectors 96 attached to the leg assemblies 22, 23, such as the first and third base assemblies 12*a*, 12*c* shown in FIG. 2. Fasteners may be tightened when the first and third base assemblies 12*a*, 12*c* are located in their final position and the beam 52 moves freely through the openings 50 of the receivers 18.

The tail unit 74 and nose unit 72 are assembled by attaching the lower wheel assembly 66 to the upper wheel tube 64. The height of the wheel assembly 60 is adjusted with different hole spacings on the upper wheel tube 64 and the lower wheel assembly 66. After the proper height is determined, fasteners fasten upper wheel tube 64 and the lower wheel assembly 66 together.

With the wheels in place, the tube units 70 are added together to form the beam 52 as described previously. The nose end 54 inserts into the receiver opening 50 of the second base assembly 12*b* when the gate assembly is closed. When closed, the beam passes through two of the base assemblies and the wheels will be lateral of two of the base assemblies. When the gate assembly is opened, the beam slides on the guide mechanism 42 and through the receiver 18 of the first base assembly 12*a* until the nose end 54 either reaches the first base assembly 12*a* (two base assemblies) or reaches the third base assembly 12*c* (three base assemblies).

A locking mechanism 110 can keep the gate apparatus 10 locked in the closed position. A pin 112, 113 with or without a cable 114 can be used with the second base assembly 12*b* to lock the beam 52. The cable 114 can attach to the receiver 18 of the second base assembly 12*b* by threading the cable 114 through the receiver opening 50. The cable 114 wraps around the outside of the receiver 18, and the pin 112 threads through a cable loop. When the gate assembly 14 is in the closed position, the pin 112, 113 may be placed through the opening 99 in the nose end 54 and locked by adding a padlock through an eye in the pin 112, 113.

What is claimed is:

1. A gate apparatus, comprising:

spaced apart base assemblies, each base assembly comprising a base frame, and a receiver;

each base frame having a base top, first and second leg assemblies extending from opposite sides of the base top, and braces attaching the first leg assembly to the second leg assembly;

each receiver having a receiver frame attaching to the base top of the of the base frame, the receiver frame having opposite first and second sides, a third side connecting the first and second sides and being opposite the base frame;

a guide mechanism attaching to each receiver;

and a sliding gate assembly having a beam engaging the guide mechanism of at least one of the receivers, and wheel assemblies attached adjacent respective ends of, the beam.

2. The gate apparatus of claim 1, wherein the beam further comprises:

nose tube having a tapered nose end; and a tail end having a tail tube at the opposite end.

3. The gate apparatus of claim 2, wherein the beam further comprises:

a spacer unit matingly engaging at least one of the nose tube and the tail tube.

4. The gate apparatus of claim 3, further comprising:

a handle projecting from the beam.

5. The gate apparatus of claim 4, wherein the sliding gate assembly further comprises:

a removable locking mechanism engaging the nose end.

6. The gate apparatus of claim 1, wherein the beam further comprises:

tube units matingly engaging each other.

7. The gate apparatus of claim 6, wherein each of the tube units further comprise:

a male end; and a female end matingly engaging the male end.

8. The gate apparatus of claim 7, wherein the male end further comprises:

an alignment tube having a first alignment aperture on a first side, and an second alignment aperture on an opposite second side.

9. The gate apparatus of claim 8, wherein the guide mechanism further comprises:

at least two roller frames attaching to the receiver frame; and at least two rollers, each roller attaching to one of the roller frames.

10. The gate apparatus of claim 9, wherein the receiver frame further comprises:

a plate attaching to the base top and the opposite first and second sides.

11. The gate apparatus of claim 10, wherein the base assemblies comprise:

a first base assembly;

a second base assembly; and a third base assembly being located between the first and second base assemblies and being linked to the first base assembly.

12. The gate apparatus of claim 1, wherein the guide mechanism further comprises:

at least two roller frames attaching to the receiver frame; and at least two rollers, each roller attaching to one of the roller frames.

13. The gate apparatus of claim 12, wherein the receiver frame further comprises:

a plate attaching to the base top and the opposite first and second sides.

14. The gate apparatus of claim 13, wherein the base assemblies comprise:

a first base assembly;

a second base assembly; and a third base assembly being located between the first and second base assemblies and being linked to the first base assembly.

15. A gate apparatus kit, comprising:

at least two base assemblies, each base assembly comprising a base frame, and a receiver;

each base frame having a base top, first and second leg assemblies extending from opposite sides of the base top, and braces attaching the first leg assembly to the leg assembly;

each receiver having a receiver frame, the receiver frame having a plate attaching to the base top of the base frame, opposite first and second sides, a third side connecting the first and second sides and being opposite the plate;

a guide mechanism attached to each receiver;

at least two tube units, each tube unit being adapted to matingly engage another tube unit;

at least two upper wheel tubes, each upper wheel tube attached to one of the tube units;

lower wheel assemblies, each at least two lower wheel assembly being adapted to engage one of the upper wheel tubes; and wherein each of the upper wheel tubes engages one of the lower wheel assemblies to form a wheel assembly attached to its respective tube unit.

16. The gate apparatus kit of claim 15, wherein the tube units further comprise:

a nose tube with a tapered nose end; and a tail tube at the opposite end.

17. The gate apparatus kit of claim 16, further comprising:

a removable locking mechanism adapted to engage the nose end of the nose tube.

18. The gate apparatus kit of claim 17, further comprising:

a handle projecting from the nose tube.

19. The gate apparatus kit of claim 16, wherein the tube units further comprise:

a spacer unit.

20. The gate apparatus kit of claim 15, wherein each of the tube units further comprise:

a male end; and a female end adapted to matingly engage the male end of another tube unit.

21. The gate apparatus kit of claim 20, wherein the male end further comprises:

an alignment tube having a first alignment aperture on a first side, and an second alignment aperture on an opposite second side.

22. The gate apparatus kit of claim 21, wherein the guide mechanism further comprises:

at least two roller frames attached to the receiver; and at least two rollers, each roller attached to one of the roller frames.

* * * * *